US008397412B2

(12) United States Patent
Rosenbaum et al.

(10) Patent No.: US 8,397,412 B2
(45) Date of Patent: Mar. 19, 2013

(54) IMAGE MOUNTING SYSTEM

(75) Inventors: Richard W. Rosenbaum, Bloomfield Hills, MI (US); Stephen F. Aulie, Ann Arbor, MI (US)

(73) Assignee: Redevex Corporation, Birmingham, MI (US)

( * ) Notice: Subject to any disclaimer, the term of this patent is extended or adjusted under 35 U.S.C. 154(b) by 1384 days.

(21) Appl. No.: 11/500,092

(22) Filed: Aug. 7, 2006

(65) Prior Publication Data

US 2007/0033848 A1 Feb. 15, 2007

Related U.S. Application Data

(60) Provisional application No. 60/706,212, filed on Aug. 5, 2005.

(51) Int. Cl.

| | |
|---|---|
| ***G09F 1/12*** | (2006.01) |
| ***G09F 1/10*** | (2006.01) |
| ***G09F 1/00*** | (2006.01) |
| ***G09F 11/23*** | (2006.01) |
| ***B42D 15/02*** | (2006.01) |

(52) U.S. Cl. ..... 40/735; 40/124.191; 273/157 R

(58) Field of Classification Search ..... 40/735, 40/124.191; 273/157 R

See application file for complete search history.

(56) References Cited

U.S. PATENT DOCUMENTS

| | | | | |
|---|---|---|---|---|
| 3,949,506 | A * | 4/1976 | Benkowski | 40/711 |
| 4,250,640 | A * | 2/1981 | Culhane | 40/776 |
| 4,745,424 | A * | 5/1988 | Cardaire | 396/661 |
| 4,756,533 | A * | 7/1988 | Hopkins et al. | 273/157 R |
| 4,779,368 | A * | 10/1988 | Thede | 40/737 |
| 5,651,547 | A * | 7/1997 | Rannelli | 273/157 R |
| 6,256,109 | B1 | 7/2001 | Rosenbaum et al. | |
| 6,702,586 | B1 * | 3/2004 | Miller | 434/406 |

* cited by examiner

*Primary Examiner* — Joanne Silbermann
*Assistant Examiner* — Syed A Islam
(74) *Attorney, Agent, or Firm* — Gifford, Krass, Sprinkle, Anderson & Citkowski, P.C.

(57) ABSTRACT

An efficient system and method for mounting an image composed of a plurality of subimages comprises a back panel onto which the subimages are mounted, and a transparent or translucent cover plate. In the preferred embodiment, the images are printed on borderless labels having a low-tack or low-aggressive type adhesive. The back panel and transparent cover plate are preferably dimensionally the same, and both may include aligned through-holes. The back panel may includes visual indicia such as score lines or alpha/numeric placement indicia to aid in mounting the subimages. The back panel and cover plate are preferably held together with a plurality of clips. An assembly method is also disclosed.

2 Claims, 1 Drawing Sheet

IMAGE MOUNTING SYSTEM

REFERENCE TO RELATED APPLICATION

This application claims priority to U.S. Provisional Patent Application Ser. No. 60/706,212, filed Aug. 5, 2005, the entire content of which is incorporated herein by reference.

FIELD OF THE INVENTION

This invention relates generally to the graphical arts and, in particular, to a system and method for efficiently mounting an image composed of a plurality of subimages.

BACKGROUND OF THE INVENTION

My U.S. Pat. No. 6,256,109, entitled Image Enlargement System, discloses methods and articles of manufacture that facilitate the partitioning of an image into a plurality of discrete sections for reassembly into an enlarged version thereof. The image to be enlarged is received in an electronic form and displayed on a display device such as that associated with a personal computer. User commands are input relating to the way in which the image is to be partitioned, including the number of discrete sections. Each section is then printed under user control, enabling the printed sections to be assembled into the enlarged version. The electronic representation of the image may be received through digitally capturing or importation from a file, a clipboard, or any other appropriate source. The image may be in black-and-white or in color, and may be produced photographically or by any other graphical or electronic process. Grid lines may be displayed along with the electronic representation of the image, and the lines or the image may be moved relative to one another prior to printing, which may take place onto a novel sheet material which may be a label or a microperforated sheet having an outer, peripheral edge and a rectangular score line spaces apart from the edge so that no unprinted gaps appear between the assembled sheets.

SUMMARY OF THE INVENTION

This invention resides in an efficient system and method for mounting an image composed of a plurality of subimages. The images may be in any form, including photographs, graphical designs, enlargements, etc. The system broadly comprises a back panel onto which the subimages are mounted, and a transparent or translucent cover plate. In the preferred embodiment, the images are printed on borderless labels having a low-tack or low-aggressive type adhesive. The back panel and transparent cover plate are preferably dimensionally the same, and both may include aligned through-holes.

In the preferred embodiment, the back panel also includes visual indicia such as score lines to aid in mounting the subimages. Corresponding alpha/numeric placement indicia may also be provided on the subimages and back panel to simplify positioning. The back panel and cover plate are preferably held together with a plurality of clips.

A method of displaying an image according to the invention includes the steps of providing a plurality of subimages which create the image when assembled in side-by-side registration; placing the subimages onto a back panel following the side-by-side registration; covering the subimages with a transparent or translucent cover plate; and joining together the back panel and the cover plate.

DETAILED DESCRIPTION OF THE INVENTION

Figure 1:
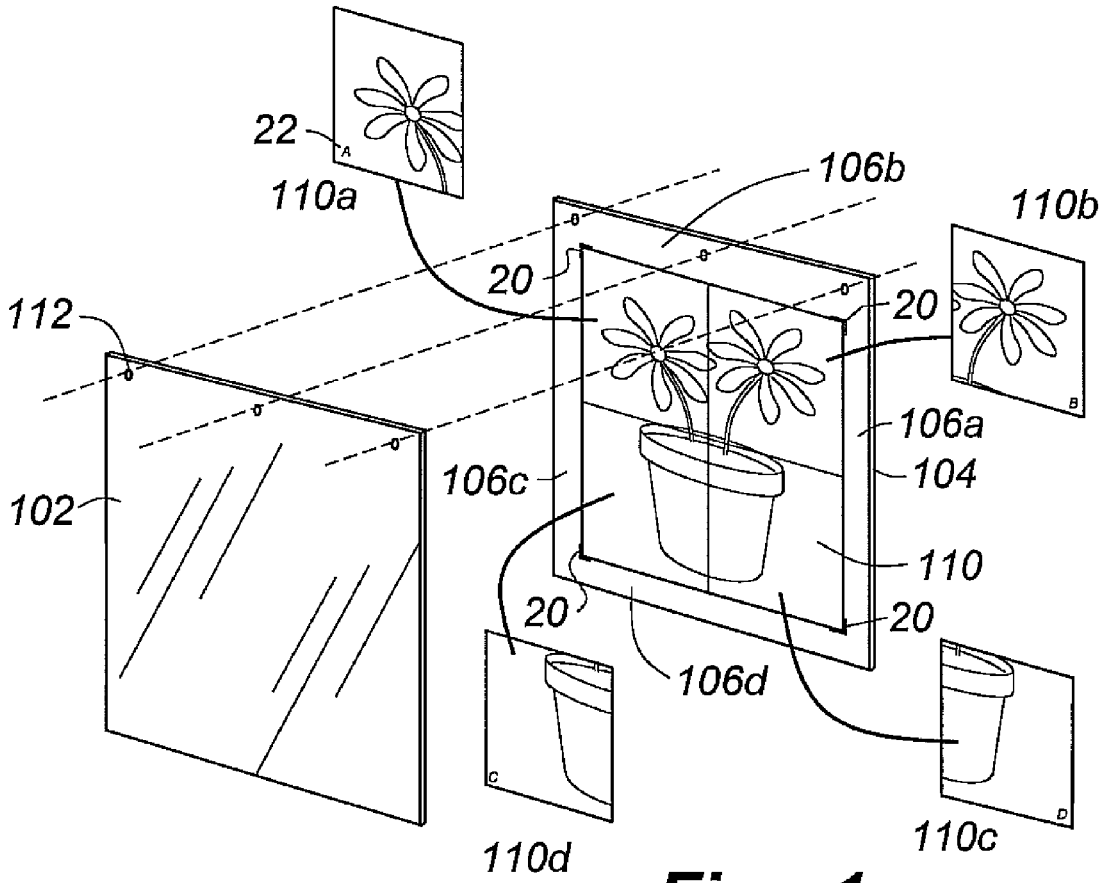
FIG. 1 is an exploded view of how a system according to the invention is assembled.

This invention broadly provides a handy and convenient system for mounting and displaying enlarged images, regardless of whether one or a plurality of rectangular panels are used to construct such images. FIG. 1 shows an exploded view of how the system is assembled, and FIG. 2 shows the final, assembled system from an oblique perspective.

Figure 2:
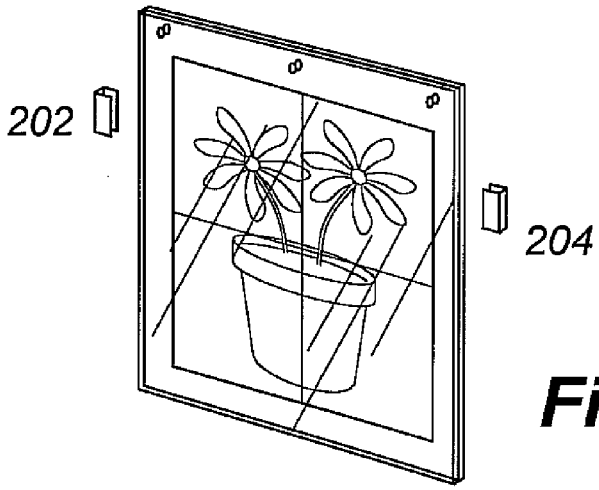
FIG. 2 shows the final, assembled system from an oblique perspective.

A transparent cover 102 is dimensionally identical to a back plate 104, such that when the two are overlaid, a finished display with a consistent border is produced, as shown in FIG. 2. Holes such as 112 are also provided in both the plate 102 and back plate 104. Although three such holes are shown, a single, central hole may be provided, or only right and left side holes. The cover plate 102 is preferably constructed from a transparent plastic such as an acrylic sheet, or the like, whereas back plate 104 may be cardboard or any other suitable mounting stock. The cover plate may also be glass, and whether glass or plastic is used, colored, translucent, or non-glare finishes may be provided.

In the system shown, four subimages 110*a*, 110*b*, 110*c*, 110*d*, which may be produced using the system and method discussed in the Background of the Invention or any other method, are assembled onto the back plate 104, creating a single enlargement. As discussed, the system is suitable for any number of subimages, such as 9, 12, 15, 25, and so forth, even already enlarged images not composed of subimages. Regardless, in the preferred embodiment, the back plate 104 includes some form of visual indicia to assist a user in positioning the image or images onto the back plate, such as score lines 20, which may be of a different color, depending upon the number of segments used. In addition, each subimage may be printed with a letter 22 or number on the back of the image or in the border which is removed, with corresponding letters or numbers printed on the back plate 104, to help the user with the correct placement. The image and sub-images are preferably printed, borderless labels including a low-tack, Post-it type adhesive; however, a more aggressive adhesive may be used as well.

Note that although four borders 106*a*, 106*b*, 106*c*, 106*d* are shown in the figure, fewer borders may be used according to the invention. As shown in FIG. 2, once the image or images are placed on the back panel 104, the front panel 102 is overlaid thereagainst, and clips 202, 204, are used to hold the pieces together. Although two clips are shown, more or fewer may be provided on any edge. Also, although the images shown as a vertically oriented image, horizontally oriented images are certainly accommodated as well.

We claim:

1. A system for mounting an image composed of a plurality of subimages with peripheral edges, comprising:

a back panel onto which the subimages are mounted immediately adjacent to one another with their edges touching, the subimages being printed on self-adhesive borderless labels;

a transparent cover plate; and wherein the back panel and transparent cover plate include aligned through-holes.

2. A system for mounting an image composed of a plurality of subimages with peripheral edges, comprising:

a back panel onto which the subimages are mounted immediately adjacent to one another with their edges touching, the subimages being printed on self-adhesive borderless labels;

a transparent cover plate; and wherein the back panel and cover plate are held together with a plurality of clips.

* * * * *